US006982376B2

(12) United States Patent
Wise

(10) Patent No.: US 6,982,376 B2
(45) Date of Patent: Jan. 3, 2006

(54) REAL DRUM TRIGGER MONITOR AND AMPLIFIED TONE MODULE

(76) Inventor: Johnathan R. Wise, 34700 Royalton Rd., Grafton, OH (US) 44044

( * ) Notice: Subject to any disclaimer, the term of this patent is extended or adjusted under 35 U.S.C. 154(b) by 221 days.

(21) Appl. No.: 10/686,709

(22) Filed: Oct. 17, 2003

(65) Prior Publication Data

US 2005/0022655 A1 Feb. 3, 2005

Related U.S. Application Data

(60) Provisional application No. 60/490,272, filed on Jul. 28, 2003.

(51) Int. Cl.
*G10H 7/00* (2006.01)
*G10F 1/08* (2006.01)

(52) U.S. Cl. ..... 84/600; 84/723; 84/730; 84/411 R; 84/104

(58) Field of Classification Search ..... 84/600–602, 84/645, 723–725, 730, 735, 104, 411 R, 477 R, 84/DIG. 24
See application file for complete search history.

(56) References Cited

U.S. PATENT DOCUMENTS

| | | | | |
|---|---|---|---|---|
| 3,553,339 | A * | 1/1971 | Dominquez et al. | 84/725 |
| 3,748,367 | A | 7/1973 | Lamme et al. | |
| 4,226,156 | A * | 10/1980 | Hyakutake | 84/730 |
| 4,700,602 | A | 10/1987 | Bozzio | |
| 5,293,000 | A * | 3/1994 | Adinolfi | 84/730 |
| 5,430,245 | A * | 7/1995 | Rogers | 84/725 |
| 2003/0004603 | A1 | 1/2003 | Hagemeister et al. | |
| 2004/0211310 | A1 * | 10/2004 | Hagiwara et al. | 84/726 |

FOREIGN PATENT DOCUMENTS

JP 11173876 A 2/1999

* cited by examiner

*Primary Examiner*—Marion Fletcher
(74) *Attorney, Agent, or Firm*—Richard C. Litman

(57) ABSTRACT

The real drum trigger monitor and amplified tone module is an electronic percussion instrument, satisfying the desire of drummers to have realistic electronic drums with the audible drum sound coming directly from the instrument triggering the sound being heard. The monitor has a speaker subsystem and patch capability mounted within an actual acoustic drum shell having a mesh drumhead and electronic trigger. The output of the electronic trigger is fed into an industry recognized tone processor before being fed back to the integrated speaker sub-system mounted in the drum, thereby producing sound coming directly from the drum activating the electronic signal. Alternatively, a traditional electronic percussion instrument may be mounted to the real drum trigger monitor and amplified tone module to provide an integrated drum trigger and speaker monitor.

20 Claims, 5 Drawing Sheets

REAL DRUM TRIGGER MONITOR AND AMPLIFIED TONE MODULE

CROSS-REFERENCE TO RELATED APPLICATION

This application claims the benefit of U.S. Provisional Patent Application Ser. No. 60/490,272, filed Jul. 28, 2003.

BACKGROUND OF THE INVENTION

1. Field of the Invention

The present invention relates to musical instruments, and particularly to electronic percussion instruments.

2. Description of the Related Art

A conventional acoustic drum consists of a hollow drum shell having one or more drumheads held in place by head hoops. While the drumhead provides the initial vibration, the hollow drum shell provides the acoustic structure necessary to provide the resonant components which gives the drum its distinctive characteristics.

Mesh drumheads have commonly been used to provide a silent surface for drummers wishing to practice in silence without generating the accompanying distinctive drum sound. Electronic drum synthesizers, which pick up the vibration of the drumhead and transmit the signals to external amplifiers, are known. An electronic trigger, often a piezoelectric sensor mounted in the vicinity of the drumhead, detects the vibrations of the drumhead and routes an electronic signal to a device having a Musical Instrument Digital Interface (MIDI), which processes note and velocity information and generates a tone according to processed data received.

Japanese Patent No. 11-173876, published in February 1999, discloses a drum having a mesh head, and a circuit module that converts the vibration of the head into an electronic signal that is then played through a loudspeaker. Furthermore, U.S. Pat. No. 4,700,602, issued to Terry Bozzio in October 1987, discloses an electronic drum having a number of transducers disposed within the drumhead that convert percussion to electrical signals, and a synthesizer that simulates the sound of a variety of instruments by modifying the signal generated by the transducers. Neither patent teaches or discloses placing a speaker inside the drum to more realistically recreate the drum sound, or to facilitate the transportation of the device.

In addition, U.S. Pat. No. 3,748,367, issued Jul. 24, 1973 to Lamme et al., describes a microphone-based percussion instrument whose signal actuates an electronic tone generator. The signal is amplified and then emitted through a loudspeaker. U.S. Patent Publication No. 2003/0004603, published Jan. 2, 2003, teaches an apparatus, which converts percussion signals, triggered by a piezoelectric sensor, into digital signals.

As disclosed in the aforementioned patents and publications, there has been effort directed to sensing the vibrations of instrument drumheads and transmitting the vibrations to electronic synthesizers, amplifiers, and speakers external to the drums themselves. Although serving several purposes, these devices do not satisfy the drummer's desire to have the amplified or otherwise synthesized sound emanate directly from the drum triggering the sound, nor do they address the issue of portability and ease of use.

None of the above inventions and patents, taken either singly or in combination, is seen to describe the instant invention as claimed. Thus a real Drum Trigger Monitor and Amplified Tone Module solving the aforementioned problems is desired.

SUMMARY OF THE INVENTION

The present invention is a real drum trigger monitor and amplified tone module, hereinafter called an electronic drum, satisfying the desire of performing drummers to have realistic electronic drums that have the audible drum sound coming directly from the instrument activating the sound being heard. This is accomplished by mounting a speaker subsystem and patch capability inside an actual acoustic drum shell with a mesh drumhead and electronic trigger.

A first embodiment includes a hollow drum shell having a mesh drumhead, a piezoelectric trigger in the vicinity of the mesh drumhead, and an integrated speaker subsystem. The trigger generates an input signal to an external tone-processing device, which then feeds a signal back into the drum shell to the speaker subsystem.

A second embodiment of the invention includes an attachable sound module, which incorporates an analog-to-digital converter, a tone processor, a digital-to-analog converter, and an amplifier, which feeds the speaker subsystem. The tone processor includes a microcomputer, memory, and program instruction code stored on the memory. This embodiment includes the capability to accept a trigger signal from an external triggering device, as well as the capability to supply its own trigger signal to an external device. Furthermore, the sound module incorporates a MIDI interface, which allows it to communicate with other MIDI compatible sound devices to supply additional tones or edit existing tones. The device includes an electronic card reader for reading additional tone information into onboard memory.

A further embodiment of the real drum trigger monitor and amplified tone module comes without the mesh drumhead and trigger sensor, and is designed to be mounted to an existing electronic percussion pad that only provides an output from a trigger sensor. Mounted beneath the existing percussion pad in place of, and plugged into, the sound module of the present invention, the combination of a traditional electronic percussion pad and the real drum speaker monitor extends the capability of a drummer's existing instrument to produce audible music without the expense of buying a complete new electronic drum.

Another embodiment of the present invention is a kit, with which a user may transform their "real" drum or electronic percussion pad into a real drum trigger monitor. The kit would include the mounting hardware necessary to mount a pair of speakers within the existing drum shell.

Accordingly, it is a principal object of the invention to provide a real drum trigger monitor and amplified tone module having an acoustic drum shell containing an electronic trigger and at least one speaker, thereby generating audible sound directly from the instrument triggering the electronic tones.

It is a further object of the invention to provide a real drum trigger monitor and amplified tone module having a trigger sensor, a speaker subsystem, and a sound module having an analog-to-digital converter, tone processor, digital-to-analog converter, and amplifier all built into the drum body.

Still another object of the invention is to provide a real drum trigger monitor and amplified tone module that is self-contained, can be easily transported and is easy to operate.

It is a further object of the invention to provide a real drum trigger monitor and amplified tone module that is MIDI compatible, that can interface to other sound systems, and that transmits and receives data to/from other compatible sources.

Still another object of the invention is to provide a device, which mounts to a traditional electronic percussion pad and generates audible sound triggered by the collocated pad.

Still another object of the invention is to provide a kit consisting of mounting hardware with which to mount a pair of speakers within an existing drum shell.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
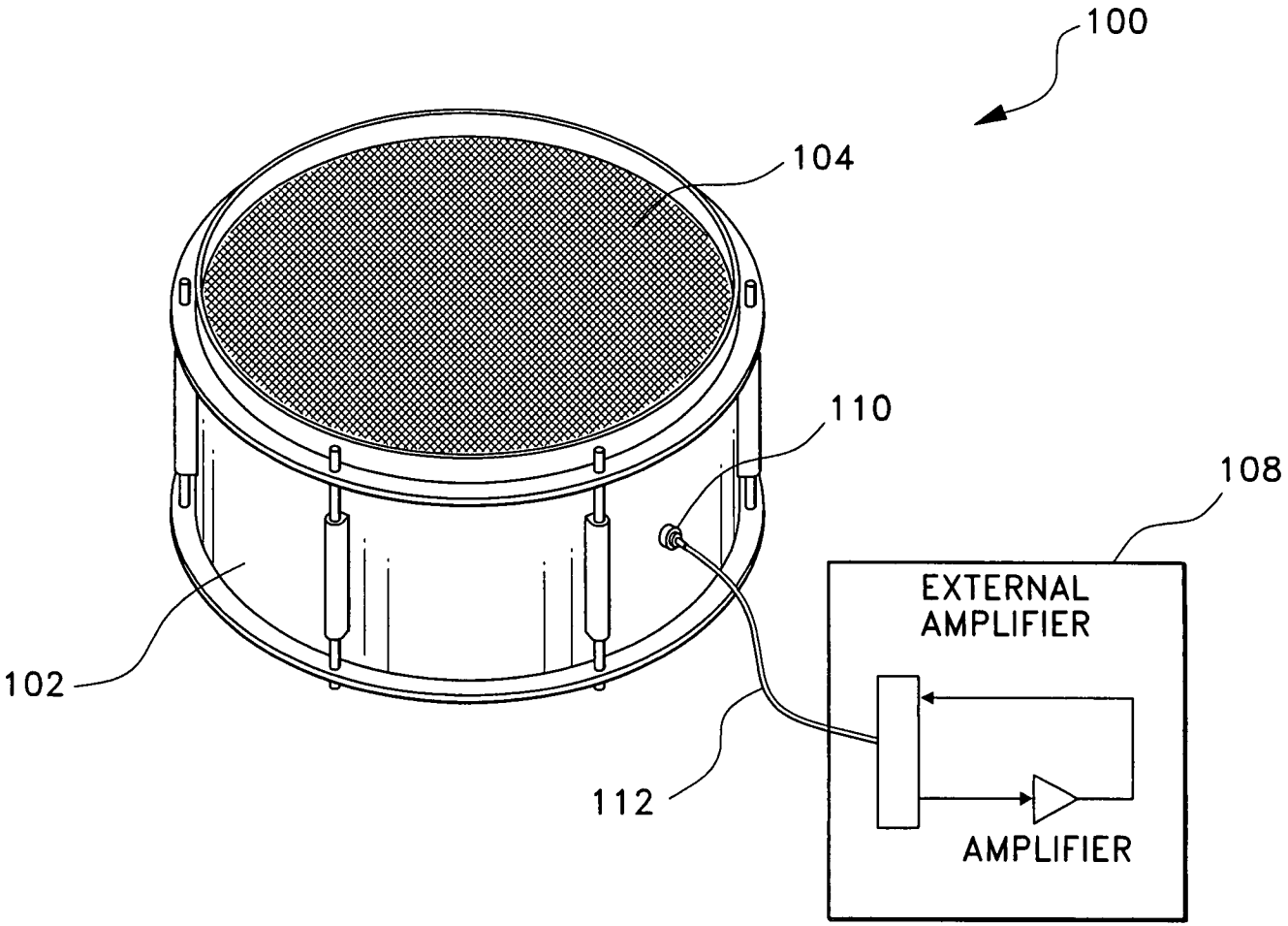
FIG. 1 is a perspective view of a real drum trigger monitor and amplified tone module according to the present invention connected to an external MIDI device.

The present invention is a real drum trigger monitor and amplified tone module, designated generally as 100 in the drawings. The real drum trigger monitor and amplified tone module 100 satisfies the desire of drummers to have realistic electronic drums that have the audible drum sound coming directly from the instrument, as opposed to an externally mounted speaker system.

Figure 2:
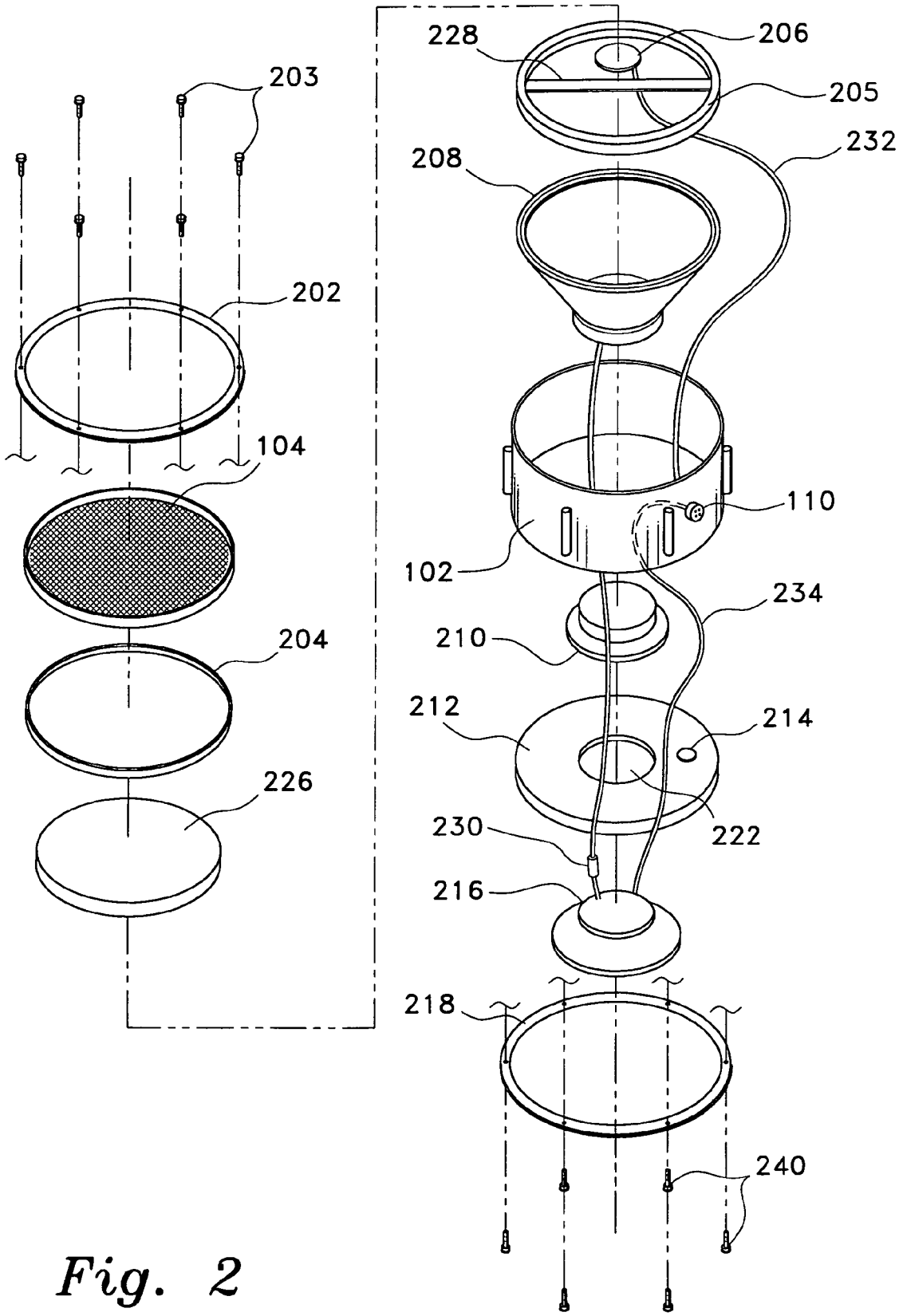
FIG. 2 is an exploded, perspective view of the real drum trigger monitor and amplified tone module according to the present invention.

As shown in FIGS. 1 and 2, the real drum monitor 100 is an actual drum shell 102 having a mesh drumhead 104 mounted to the drum shell 102 and utilizes a foam damper 226 to make contact with trigger sensor 206. The trigger sensor 206 is centrally mounted on bracket 228, which itself is mounted to upper speaker mounting plate 205. The sensor 206 may be one of several piezoelectric drumhead vibration sensors commercially available, such as the Pintech® RS-5 head/shell mount acoustic drum trigger. A spacer ring 204 inserted between the drumhead 104 and the upper speaker mounting plate 205 provides the separation necessary for the foam damper 226. A retaining ring 202 having uniformly spaced apertures for receiving mounting bolts 203 mounts on top of the drumhead 104 and is secured to the body of the drum shell 102. It is noted that the mounting of sensor 206 is not limited to the bracket 228, but any support known in the art would be useable.

The signal from trigger sensor 206 is routed by cable 232 through connector 110 and cable 112 to an external Musical Instrument Digital Interface (MIDI) device 108 having a tone processor and amplifier. External tone processors are known to those in the music field and operate on note and velocity information to produce a tone according to processed data received. The tone processor outputs an analog signal to an amplifier, which electrically transmits an amplified analog signal back into the electronic drum 100 through cable 112 and connector 110. Cable 234 routes the signal from the connector 110 to the speaker subsystem mounted inside the drum shell 102.

The speaker subsystem is comprised of a low frequency speaker 208 and a high midrange speaker 216 wired in series through a crossover circuit 230. Crossover circuits are known in the electronic audio field and crossover circuit 230 effectively limits the speakers 208, 216 to their respective portion of the audible frequency bandwidth. An upper speaker mounting plate 205 with a center speaker hole is bolted on top of the low frequency speaker 208. The upper speaker mounting plate 205 is sized to abut the outer periphery of the drum shell 102. As previously mentioned, spacer ring 204 is mounted on top of the mounting plate 205 and provides the space required for foam damper 226. Retaining ring 202 is placed over the mesh drumhead 104 and is secured to the drum shell 102 with mounting bolts 203.

The high midrange speaker 216 is bolted to a lower speaker plate 212 having a center speaker hole 222 and at least one small vent hole 214. A chamber separator housing 210 is mounted to the lower speaker mounting plate 212 and operates to prevent the air pressure from the low frequency speaker 208 from interfering with the high midrange speaker 216. The outer periphery of the lower speaker mounting plate 212 abuts the bottom of the drum shell 102 and is held in place by lower retaining ring 218 and lower mounting bolts 240.

Different configurations, types and sizes of speakers may be used, as well as different shell sizes and shell materials to produce a different tone and resonance. Wood shells produce a natural drum tone, while plastic and composite material produces "boomier" tones. Decibel levels are also determined by shell size, shell material, speaker size, and amplifier wattage.

Figure 3:
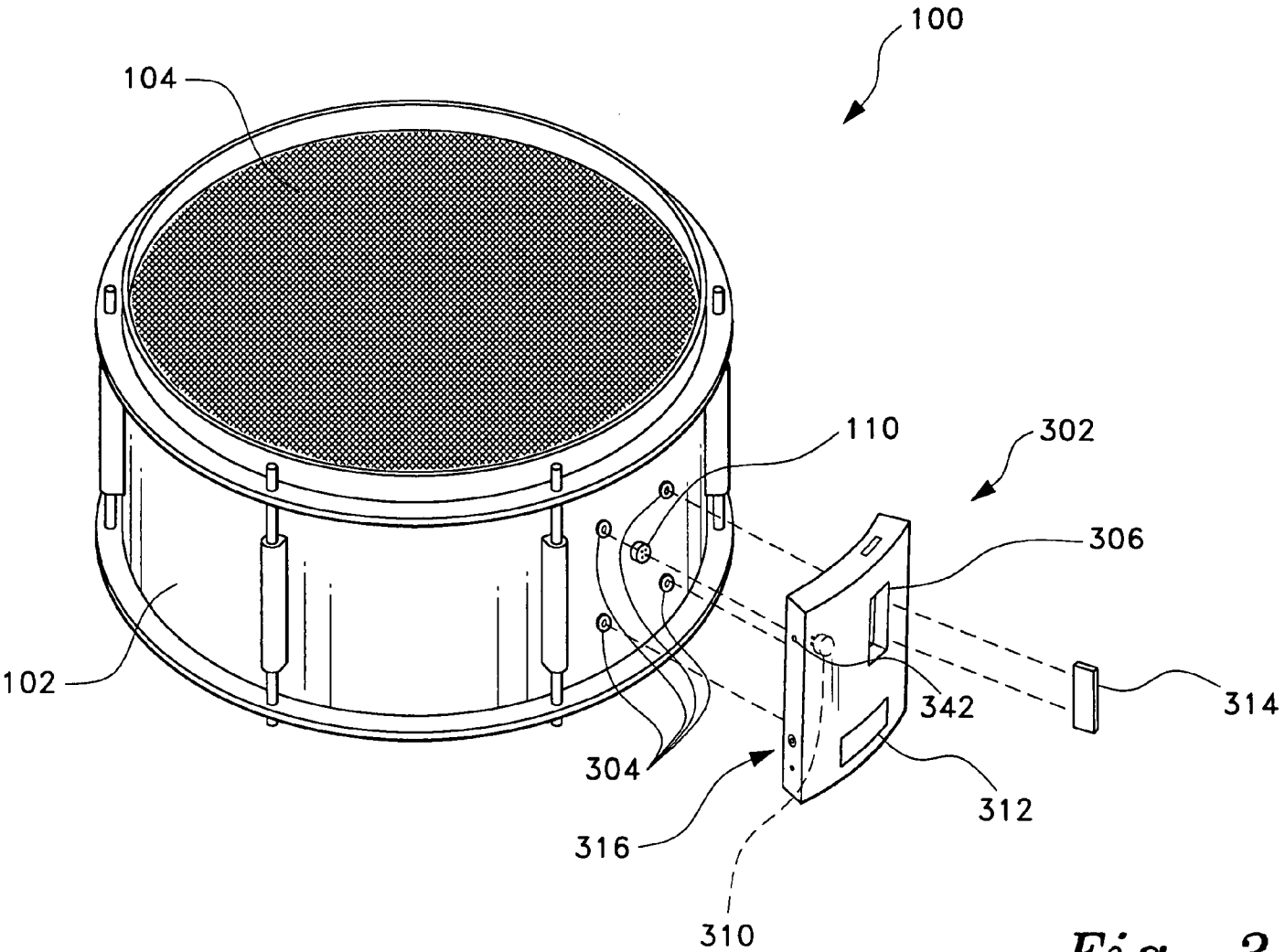
FIG. 3 is a perspective view of an alternate embodiment of the real drum trigger monitor and amplified tone module according to the present invention having a sound module removably mounted to the side of the drum shell.

FIG. 3 shows an alternate embodiment of the present invention 100, which incorporates a small self-contained battery powered MIDI sound module 302 mounted directly to the drum shell 102 with mounting hardware 304. The sound module 302 accepts the signal from the trigger sensor 206 and, based upon stored or external tone characteristics, creates audio signals, which are played back by the speakers 208, 216 within the electronic drum 100.

The sound module 302 has a rear-mounted connector 310 which mates with connector 110 on the surface of the drum shell 102. Alternatively, connector 110 may be disposed on the inside surface of drum shell 102 and the sound module 302 mounted to the interior of the drum shell 102, thereby eliminating from view the internally mounted sound module 302. Disposed in the sound module 302 is an electronic card reader 306 for loading different tones into the sound module from a portable electronic storage medium 314. Furthermore, the sound module 302 has disposed thereon a conveniently accessible user interface, comprising, at a minimum, input and output connectors, and a control panel 316.

Finally, the sound module 302 has a battery holder 312 for accepting a conventional rechargeable battery (not shown). Alternatively, the sound module 302 may be powered from 120 VAC using a commercially available AC/DC converter.

Figure 4:
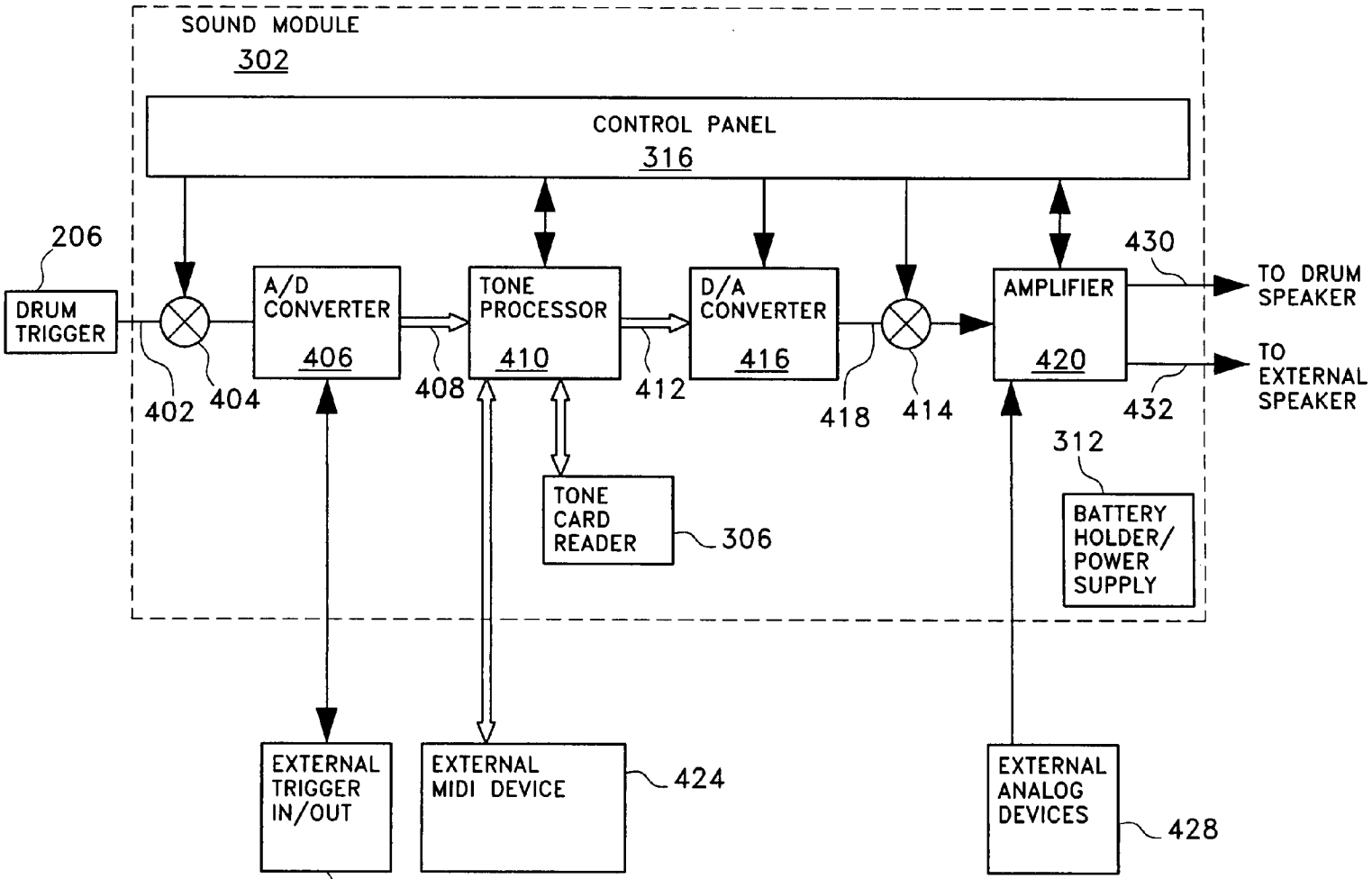
FIG. 4 is a representative block diagram of the sound module of the real drum trigger monitor and amplified tone module according to the present invention.

As shown in the representative block diagram of FIG. 4, the drum trigger 206 produces a distorted voltage signal 402 as a result of the vibrating drumhead 104. The voltage level of this distorted signal 402 may be adjusted by sensitivity control 404 before being digitized by analog-to-digital converter 406, which outputs a digitized signal 408 to the tone module 410. Alternatively, connectors on the sound module 302 allow an external device 426 to process the drum trigger signal or to provide its own sensor input through connector 342.

The tone processor 410 accepts digitized trigger data in conjunction with selected tone characteristics to create synthetic sounds. These tone characteristics are selected via the user interface 316, and may be read from a variety of sources, including on-board memory, an external MIDI device 424, and a card reader 306. Tone data includes, but is not limited to, velocity, curve, note number, sensitivity, amplitude, and channel number. The tone processor 410 stores multiple tones and patches multiple 16-bit digital audio samples. The tone processor 410 contains a microprocessor, read only memory (ROM), random access memory (RAM), assorted logic, and software loaded on the memory.

The tone processor 410 outputs digital data 412 to an digital-to-analog converter 416, which then converts the digital data into an analog signal 418, which may be further attenuated by means of control panel 316 and control 414 before being sent on to the amplifier module 416 which outputs two pairs 430, 432 of balanced analog signals, one pair 430 driving the internal drum speakers 208, 216, and the other pair 432 capable of driving an external speaker or amplifier. The amplifier module 414 may have its own control capability by means of control panel 316.

The present invention 100 is capable of interoperating with commercially available devices at several key interface points. As previously disclosed, the output of the trigger sensor 206 may serve as an input to other electronic devices, and the trigger output of external devices may serve as input to the sound module 302. In addition, the sound module 302 is a MIDI device, adapted to interface with commercially available MIDI devices 424 for providing such functions as reading in tone information and editing existing tones. Furthermore, the sound module 302 allows the speaker subsystem of the present invention to be driven by external analog devices 428.

Figure 5:
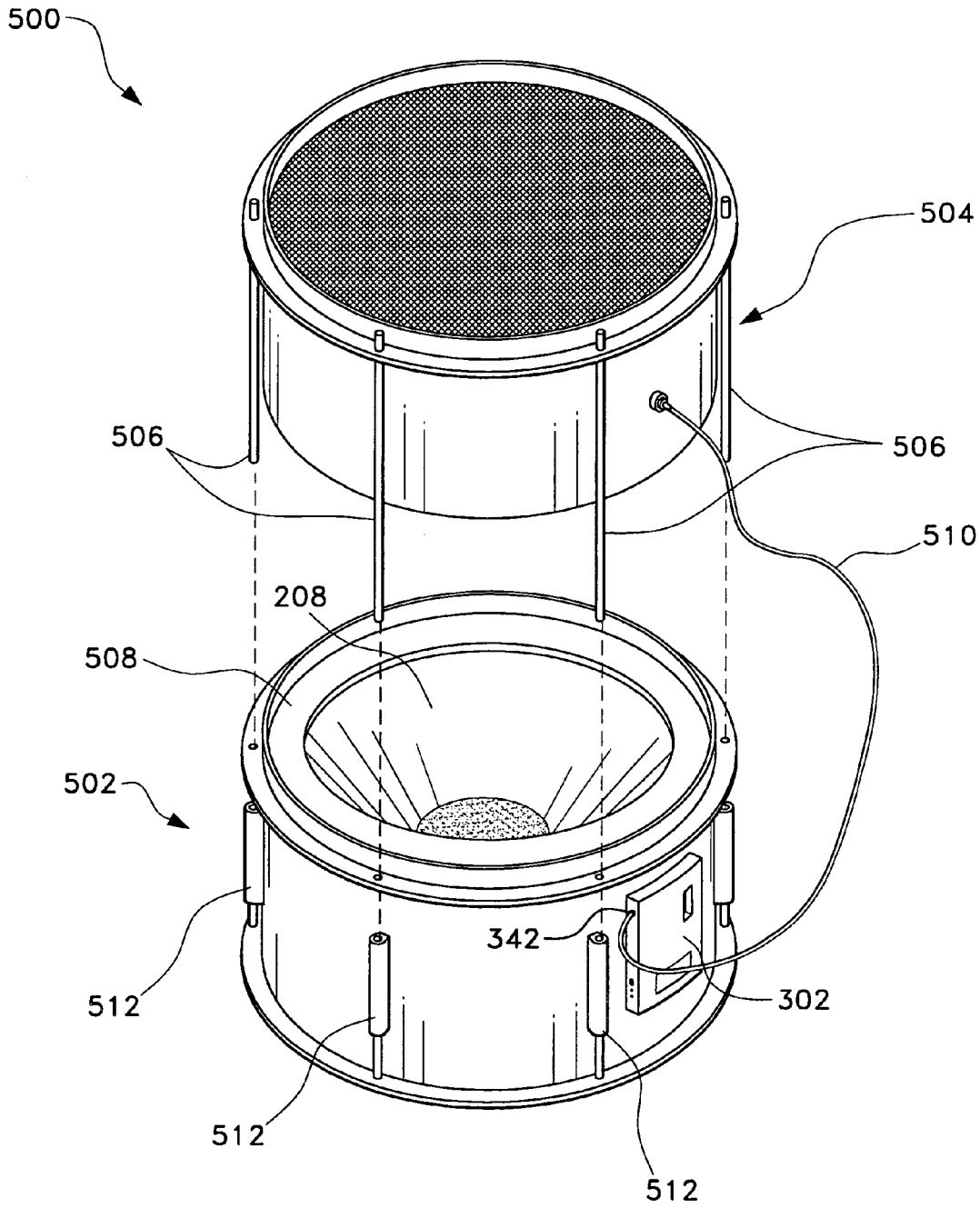
FIG. 5 is a perspective view showing a conventional electronic percussion pad modified for use with a real drum trigger monitor and amplified tone module according to the present invention.

FIG. 5 discloses a further embodiment of the present invention having an electric drum 500 which allows traditional electronic percussion instruments having only a trigger sensor output, such as the Roland® PD120 12-inch Mesh head V-Pad 504, to be easily mounted and wired to the electronic drum 500, thereby producing audible sound when triggered. The modification requires that the user's traditional electronic percussion instrument 504 be mounted directly to the top of the drum shell 502 and be held in place by long mounting bolts 506 received by mounting hardware 512, upper mounting plate 508 being disposed between the meshhead 504 and the low frequency speaker 208. The modifications are straightforward and may be accomplished by most drummers and those experienced in the field of percussion instruments. A cable 510 would connect the user's drum to the external trigger input connector 342 on the removably attached sound module 302 discussed in detail above.

In its simplest form, the present invention comprises a hardware mounting kit having only the proprietary upper speaker mounting plate 205, spacer ring 204, and the lower speaker mounting plate 212. A user, supplying a real drum, a drum trigger, a tone module, a pair of speakers, and an external tone module, may then transform their percussion drum into a real drum trigger monitor and amplified tone module, as described above. An alternate use of the kit would be to convert an electronic percussion pad into a real drum trigger monitor by having the user provide their own percussion pad, real drum, and speakers.

It is to be understood that the present invention is not limited to the embodiments described above, but encompasses any and all embodiments within the scope of the following claims.

I claim:

1. A real drum trigger monitor and amplified tone module, comprising:

a hollow drum shell having at least one drumhead closing one end of the drum shell for sensing vibrations of the drumhead;

an electronic trigger sensor mounted within the drum shell, the trigger sensor having an output;

a speaker subsystem mounted within the drum shell, the speaker subsystem having an input for receiving a signal;

wherein said speaker subsystem generates an audible sound;

a drum shell connector disposed on the drum shell, the drum shell connector having an input portion and an output portion, the output portion being electrically connected to the output of the trigger sensor and the input portion of the connector being electrically connected to the input of the speaker subsystem whereby said speaker subsystem produces said audible sound corresponding to the sensed vibrations of the drumhead.

2. The real drum trigger monitor and amplified tone module according to claim 1, wherein said speaker subsystem further comprises:

a low frequency speaker;

a high midrange speaker; and means for controlling an operating frequency range of the speakers.

3. The real drum trigger monitor and amplified tone module according to claim 1, wherein said speaker subsystem further comprises:

an upper speaker mounting plate disposed within said drum shell;

a spacer ring disposed on top of the upper speaker mounting plate, beneath said drumhead; and a lower speaker mounting plate disposed within said drum shell, the lower speaker mounting plate having at least one vent hole disposed therein.

4. The real drum trigger monitor and amplified tone module according to claim 1, further comprising a sound module having:

a housing removably attached to said drum shell, the housing having a front and a rear;

a housing connector disposed on the rear of the housing, the housing connector being electrically connected to said drum shell connector when the sound module is mounted to said drum shell;

an analog-to-digital converter having an input and an output, the input being electrically connected to the housing connector, whereby the output of said trigger sensor is electrically connected to the input of the analog-to-digital converter when the sound module is mounted to said drum shell;

a tone processor having input and output signals, the input of the tone processor being connected to the output of the analog-to-digital converter;

a digital-to-analog converter having an input and an output, the input of the digital-to-analog converter being connected to the output of the tone processor; and an amplifier having an input and an output, the amplifier input being connected to the output of the digital-to-analog converter, the output of the amplifier being electrically connected to the output of the housing connector, whereby the output of the amplifier is electrically connected to the input of said speaker subsystem when the sound module is mounted to said drum shell.

5. The real drum trigger monitor and amplified tone module according to claim 4, wherein said sound module further comprises:

a control panel; and power means for supplying operative electric power to the real drum trigger monitor and amplified tone module.

6. The real drum trigger monitor and amplified tone module according to claim 5, wherein said control panel includes:

an LCD display;

a MIDI patch control;

means for adjusting sensitivity of the output of said trigger sensor; and means for adjusting output level of said digital-to-analog converter.

7. The real drum trigger monitor and amplified tone module according to claim 4, wherein said sound module includes:

an interface connecting the input from said analog-to-digital converter to an external device; and an interface connecting an external trigger signal to the input of said analog-to-digital converter.

8. The real drum trigger monitor and amplified tone module according to claim 4, wherein said tone processor includes a microprocessor, memory, program instruction code stored on said memory, and a plurality of tones digital stored on said memory.

9. The real drum trigger monitor and amplified tone module according to claim 4, wherein said tone processor further comprises a MIDI compatible interface to an external MDI device.

10. The real drum trigger monitor and amplified tone module according to claim 4, wherein said sound module further comprises a tone card reader electrically connected to said tone processor, whereby additional tones may be read into said memory.

11. The real drum trigger monitor and amplified tone module according to claim 10, wherein said sound module further comprises a control panel and power means for supplying operative electric power to the real drum trigger monitor and amplified tone module.

12. The real drum trigger monitor and amplified tone module according to claim 11, wherein said control panel further includes:

an LCD display;

a MIDI patch control;

means for adjusting sensitivity of the output of said trigger sensor; and means for adjusting voltage output level of said digital-to-analog converter.

13. A real drum trigger monitor and amplified tone module adapted to receive an electronic percussion instrument having a trigger sensor output, the real drum trigger monitor and amplified tone module comprising:

a hollow drum shell;

a speaker subsystem mounted within the drum shell, the speaker subsystem having an input for receiving a signal;

wherein said speaker subsystem generates an audible sound;

a drum shell connector disposed on the drum shell, the drum shell connector being electrically connected to the input of the speaker subsystem; and a sound module removably attached to the drum shell, the sound module including a housing having:

a front and a rear;

a housing connector disposed on the rear of the housing, the housing connector engaging said drum shell connector when the sound module is mounted to said drum shell;

a trigger input connector adapted to receive the trigger sensor output of an electronic percussion instrument;

an analog-to-digital converter having an input and an output, the input being electrically connected to the trigger input connector;

a tone processor having input and output signals, the input of the tone processor being connected to the output of the analog-to-digital converter;

a digital-to-analog converter having an input and an output, the input of the digital-to-analog converter being connected to the output of the tone processor; and an amplifier having an input and an output, the amplifier input being connected to the output of the digital-to-analog converter, the output of the amplifier being electrically connected to the output of the housing connector, whereby the output of the amplifier is electrically connected to the input of said speaker subsystem when the sound module is mounted to said drum shell.

14. The real drum trigger monitor and amplified tone module according to claim 13, wherein said speaker subsystem further comprises:

a low frequency speaker;

a high midrange speaker; and means for controlling an operating frequency range of the speakers.

15. The real drum trigger monitor and amplified tone module according to claim 13, wherein said sound module further comprises a tone card reader electrically connected to said tone processor, whereby additional tones may be read into said memory.

16. The real drum trigger monitor and amplified tone module according to claim 13, wherein said tone processor includes a microprocessor, memory, program instruction code stored on said memory, a plurality of tones digital stored on said memory.

17. The real drum trigger monitor and amplified tone module according to claim 13, wherein said tone processor comprises a MIDI compatible interface to an external MIDI device.

18. A real drum trigger monitor kit for converting a drum and at least one speaker into a real drum trigger monitor, the drum having a hollow drum shell and at least one drumhead closing one end of the drum shell, the real drum trigger monitor kit comprising:

at least one monitor speaker for generating an audible sound;

an upper speaker mounting plate adapted for mounting within the drum and adapted for having the at least one speaker secured thereto;

a spacer ring inserted between the upper speaker mounting plate and the drumhead, a trigger sensor pickup for sensing vibrations of the drumhead and generating an output;

at least one mounting bracket for supporting said sensor in juxtaposition to the drumhead;

a lower speaker mounting plate adapted for mounting within the drum and adapted for having another at least one monitor speaker for generating the audible sound mounted thereto, the lower speaker mounting plate having at least one vent hole disposed therein;

first and second electrical connectors, said first electrical connectors for conducting signals from an output of said trigger sensor, said second electrical connectors for conducting signals to an input of each said at least one monitor speaker; and a circuit unit designed and configured to receive the signals from said first electrical connectors, process and amplify the received signals, and generate output signals to said second electrical connectors;

whereby each said at least one monitor speaker produces an audible sound corresponding to the sensed vibrations of the drumhead.

19. The real drum trigger monitor kit according to claim 18, wherein said upper speaker mounting plate and said spacer ring form a single unitary structure.

20. The real drum trigger monitor kit according to claim 18, said circuit unit comprises a tone processor and an amplifier, said tone processor converting said sensed vibrations into audio signals corresponding to at least a drum sound, and said amplifier amplifying said audio signals to each said at least one monitor speaker.

* * * * *